US008345511B1

(12) United States Patent
Rikoski

(10) Patent No.: US 8,345,511 B1
(45) Date of Patent: Jan. 1, 2013

(54) BLAZED ARRAY FOR BROADBAND TRANSMISSION/RECEPTION

(75) Inventor: Richard J. Rikoski, Alameda, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 351 days.

(21) Appl. No.: 12/798,168

(22) Filed: Mar. 15, 2010

(51) Int. Cl.
*H01Q 3/00* (2006.01)

(52) U.S. Cl. ..... 367/138; 342/157; 356/484

(58) Field of Classification Search ..... 367/103, 367/138, 119, 154; 600/444; 342/157; 356/484
See application file for complete search history.

(56) References Cited

U.S. PATENT DOCUMENTS

| | | | | |
|---|---|---|---|---|
| 4,170,012 | A * | 10/1979 | Kaloi | 343/700 MS |
| 5,045,746 | A * | 9/1991 | Wersing et al. | 310/334 |
| 5,515,341 | A * | 5/1996 | Toda et al. | 367/140 |
| 7,606,114 | B2 * | 10/2009 | Bachelor et al. | 367/138 |
| 7,795,784 | B2 * | 9/2010 | Davidsen et al. | 310/334 |
| 8,159,387 | B1 * | 4/2012 | Fernandez et al. | 367/129 |
| 2005/0007882 | A1 * | 1/2005 | Bachelor et al. | 367/103 |
| 2008/0130413 | A1 * | 6/2008 | Bachelor et al. | 367/103 |
| 2009/0009421 | A1 * | 1/2009 | Suprunov et al. | 343/881 |
| 2010/0074057 | A1 * | 3/2010 | Bachelor et al. | 367/103 |
| 2010/0160783 | A1 * | 6/2010 | Halmann et al. | 600/447 |

* cited by examiner

*Primary Examiner* — Daniel Pihulic
(74) *Attorney, Agent, or Firm* — James T. Shepherd

(57) ABSTRACT

A broadband blazed array has a plurality of elements. The elements are arranged side-by-side in a non-parallel spaced apart fashion with center-to-center spacing between adjacent elements being identical along cross-sections of the array that are aligned with the array's endfire directions.

5 Claims, 2 Drawing Sheets

BLAZED ARRAY FOR BROADBAND TRANSMISSION/RECEPTION

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to blazed arrays, and more particularly to a blazed array configured for broadband transmission and/or reception of signals such as radar and sonar signals.

BACKGROUND OF THE INVENTION

Blazed arrays are known multi-element transmission and/or reception devices used in sonar and radar systems. That is, each element in a blazed array can transmit and/or receive acoustic signals (in the case of sonar) or electromagnetic signals (in the case of radar). A conventional blazed array is illustrated in FIG. 1 and referenced generally by numeral 10. Blazed array 10 has a number of identical elements 12 arranged in a parallel and spaced-apart fashion. As is known in the art, blazed array 10 transmits the same signal from all elements 12 (subject to an element specific phase shift), but transmits different frequencies in different directions due to the phase shift. The frequency content of the transmitted signal varies with transmitter aspect due to constructive interference between the signals of individual elements 12. A significant limitation of blazed array 10 is that the signal transmitted in any particular direction is a narrowband signal. However, this limits both the amount of target signature information that can be gathered and the range resolution. Further, a conventional blazed array is generally limited to quarter cycle phase spacing for correspondence with quadrature signal components, i.e., real, imaginary, negative real and negative imaginary.

SUMMARY OF THE INVENTION

Accordingly, it is an object of the present invention to provide a blazed array capable of broadband signal transmission and/or reception.

Another object of the present invention is to provide a broadband blazed array that is not limited to quarter cycle phase spacing.

Other objects and advantages of the present invention will become more obvious hereinafter in the specification and drawings.

In accordance with the present invention, a blazed array for broadband operation has a plurality of elements that form the array. Each element is capable of at least one of transmission of signals through a medium, reception of signals from a medium, and passage of signals propagating through a medium. The array defines opposing endfire directions at either end thereof. The elements are arranged side-by-side in a non-parallel spaced apart fashion with center-to-center spacing between adjacent elements being identical along cross-sections of the array that are aligned with the endfire directions.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
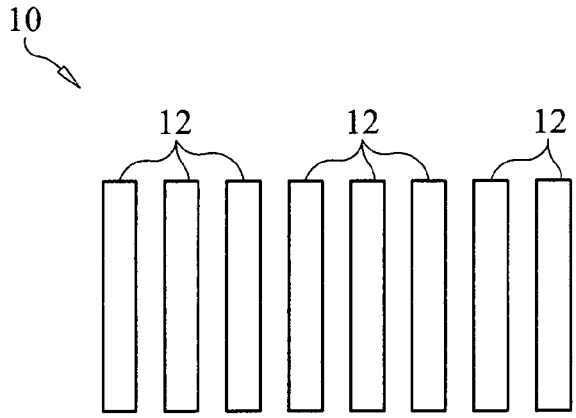
FIG. 1 PRIOR ART
FIG. 1 is a schematic view of a conventional, parallel-element blazed array.
Figure 2:
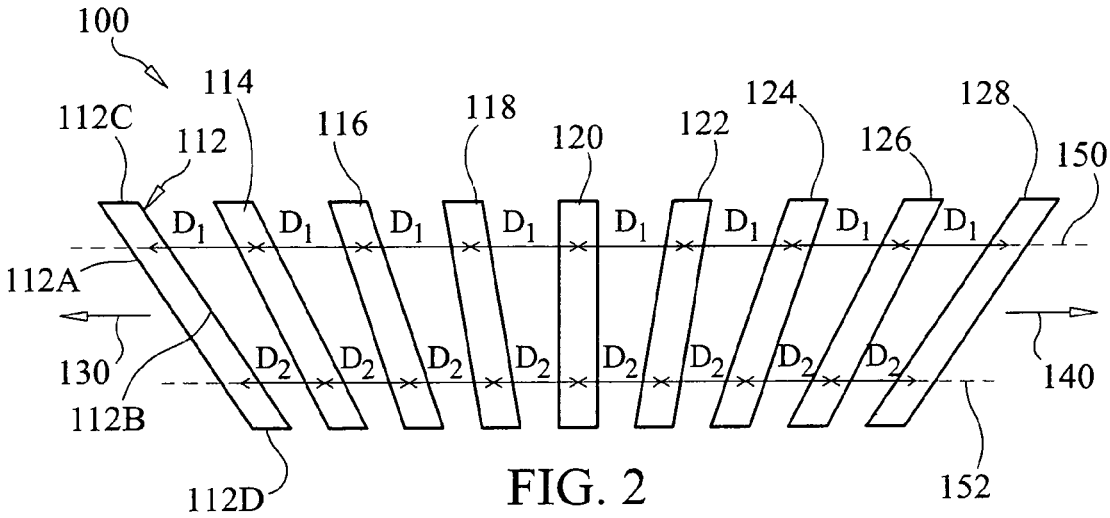
FIG. 2 is a schematic view of a broadband blazed array using straight-edge elements in accordance with an embodiment of the present invention.

Referring now to the drawings and more particularly to FIG. 2, a broadband blazed array in accordance with an embodiment of the present invention is shown and is referenced generally by numeral 100. In general, broadband blazed array 100 includes a number of elements 112-128 lying in a plane that is, for purpose of the description, the plane of the paper. Each of elements 112-128 is capable of transmission and/or reception of signals that propagate through a medium. For example, if the medium is water or another liquid, each of elements 112-128 is a sonar element capable of transmission/reception of acoustic signals. However, if the medium is air or another gas, each of elements 112-128 is a radar element capable of transmission/reception of electromagnetic signals. The materials used for such elements and the constructions thereof are well known to those of ordinary skill in the art.

Still further, elements 112-128 could be optical elements such as open slits such that array 100 defines an optical diffraction grating that provides for the passage of light or other coherent waveforms therethrough.

In the illustrated embodiment, each of elements 112-128 is substantially rectangular in shape such that the long sides thereof are straight and parallel to one another. For example, element 112 has straight long sides 112A and 112B extending parallel to one another. The short sides of each of elements 112-128 can be straight and parallel to one another, or curved/nonlinear without departing from the scope of the present invention. By way of illustrative example and with reference again to element 112, short sides 112C and 112D are shown as being straight and parallel to one another.

In accordance with the present invention, elements 112-128 are spaced apart from one another in array 100. More specifically, elements 112-128 fan out such that elements 112-128 are non-parallel to one another. As would be understood in the art, opposing endfire directions 130 and 140 are defined at either end of array 100 with direction 130 and 140 being aligned with the length dimension of array 100.

In the present invention, the fanned, non-parallel relationship of elements 112-128 is such that the spacing between adjacent elements is the same for any cross-section of array 100 that is aligned with endfire directions 130 and 140. To illustrate this feature, two cross-sections of array 100 are designated by dashed lines 150 and 152. Each cross-section 150 and 152 is aligned with endfire directions 130 ad 140. Along cross-section 150, the center-to-center spacing between elements 112-128 is identical and is designated $D_1$. Along cross-section 152, the center-to-center spacing between elements 112-128 is identical and is designated $D_2$.

Note that $D_1 > D_2$ and that, in general, the center-to-center spacing $D_N$ is unique for each such cross-section of array 100 that is aligned with endfire directions 130 and 140.

Figure 4:
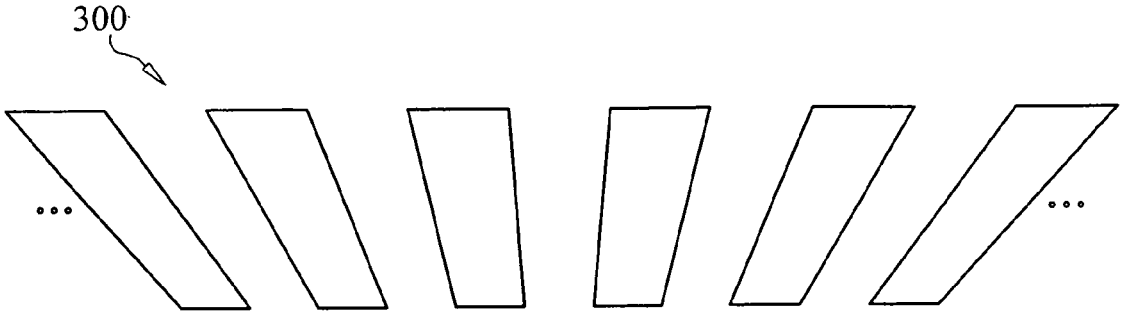
FIG. 4 is a schematic view of a portion of a broadband blazed array using substantially trapezoidal-shaped elements in accordance with another embodiment of the present invention.
Figure 3:
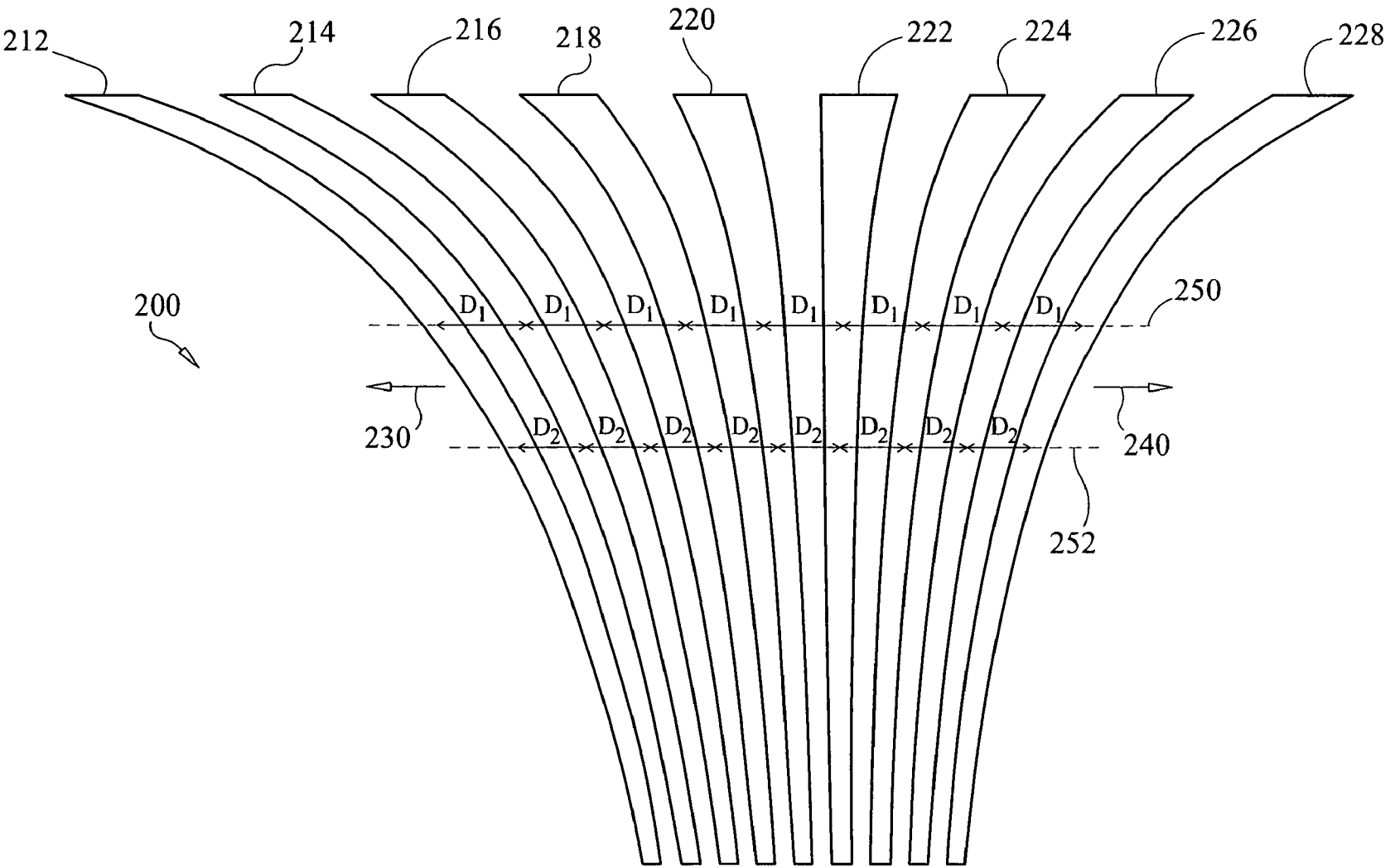
FIG. 3 is a schematic view of a broadband blazed array using curved-edge elements in accordance with another embodiment of the present invention.

It is to be understood that the present invention is not limited to substantially rectangular, straight-sided elements as described above. For example, the short side ends of the elements could be curved or otherwise nonlinear without departing from the scope of the present invention. Each element could also have its long sides curved as illustrated in FIG. 3 where array 200 includes curved elements 212-228. Similar to the previous embodiment, array 200 defines opposing endfire directions 230 and 240 with spacing between adjacent elements being the same along cross-sections of array 200 that are aligned with endfire directions 230 and 240. For example, equal spacings designated as $D_1$ are defined along cross-section 250, and equal spacings designated as $D_2$ are defined along cross-section 252. Still further, each element could be substantially trapezoidal in shape in order to increase element surface area. A portion of an array 300 comprised of substantially trapezoidal-shaped elements is illustrated in FIG. 4.

For broadband blazed arrays constructed in accordance with the present invention, phase spacing is not limited to quarter cycle phase spacing as is the case with conventional, parallel-element arrays. Accordingly, the present invention allows for a wider range of operating frequencies. With conventional quarter cycle spacing, the ratio of the highest-to-lowest operating frequency is 3:1. If the array operates at frequencies above this band there will be at least two lobes per frequency thereby eliminating the ability to unambiguously determine angle by frequency. In contrast, the present invention provides for the more general case of 1/N cycle delays so that the ratio of the highest-to-lowest frequency is (N−1):1. This increased operational range permits the present invention to have high resolution at a given center frequency as well as gather more target signature information.

The advantages of the present invention are numerous. A blazed array can be constructed for broadband transmission/reception operation through the use of non-parallel array-element arrangements. Further, the broadband blazed array is not limited to quarter cycle phase spacing thereby facilitating a broader range application environments.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A blazed array for broadband operation, comprising:

a plurality of straight-sided elements forming an array, each of said elements capable of at least one of transmission of signals through a medium, reception of signals from a medium, and passage of signals propagating through a medium, said array defining opposing endfire directions at either end thereof, said elements arranged side-by-side in a fanned out fashion with center-to-center spacing between adjacent ones of said elements being identical along cross-sections of said array that are aligned with said endfire directions, and with said center-to-center spacing being unique for each of said cross-sections.

2. A blazed array as in claim 1, wherein each of said elements comprises a sonar element.

3. A blazed array as in claim 1, wherein each of said elements comprises a radar element.

4. A blazed array as in claim 1, wherein each of said elements comprises an optically transmissive element.

5. A blazed array as in claim 1, wherein each of said elements has ends that are parallel to said endfire directions.

* * * * *